United States Patent [19]

Kirkham

[11] Patent Number: 4,582,637

[45] Date of Patent: Apr. 15, 1986

[54] REPROCESSING OF IRRADIATED NUCLEAR FUEL

[75] Inventor: Ian A. Kirkham, Seascale, England

[73] Assignee: British Nuclear Fuels Ltd., United Kingdom

[21] Appl. No.: 241,648

[22] Filed: Mar. 9, 1981

[30] Foreign Application Priority Data

Mar. 28, 1980 [GB] United Kingdom ..... 8010560

[51] Int. Cl.[4] ..... G21F 9/16; G21F 9/04

[52] U.S. Cl. ..... 252/628; 210/710; 210/751; 252/631

[58] Field of Search ..... 423/11; 252/626, 628, 252/629, 631, 633, 634; 210/682, 710, 751

[56] References Cited

U.S. PATENT DOCUMENTS

| | | | |
|---|---|---|---|
| 4,077,874 | 3/1978 | Conley | 210/725 |
| 4,180,476 | 12/1979 | Anav et al. | 252/631 |
| 4,265,861 | 5/1981 | Cleary | 423/11 |
| 4,273,745 | 7/1981 | Laferty et al. | 423/11 |

FOREIGN PATENT DOCUMENTS

| | | | |
|---|---|---|---|
| 502558 | 4/1979 | U.S.S.R. | 252/628 |

OTHER PUBLICATIONS

Blanco et al, ORNL-TM-830, Waste Treatment and Disposal Quarterly Progress Report, Nov. 1963 to Jan. 1964, pp. 59 to 66.

*Primary Examiner*—John F. Terapane
*Assistant Examiner*—Howard J. Locker
*Attorney, Agent, or Firm*—Larson and Taylor

[57] ABSTRACT

In the treatment of radioactive effluent it is known to produce a floc being a suspension of precipitates carrying radioactive species in a mother liquor containing dissolved non-radioactive salts. It is also known and accepted practice to encapsulate the floc in a solid matrix by treatment with bitumen, cement and the like. In the present invention the floc is washed with water prior to encapsulation in the solid matrix whereby to displace the mother liquor containing the dissolved non-radioactive salts. This serves to reduce the final amount of solidified radioactive waste with consequent advantages in the storage and disposal thereof.

2 Claims, No Drawings

REPROCESSING OF IRRADIATED NUCLEAR FUEL

BACKGROUND OF THE INVENTION

The present invention concerns the treatment of radioactive effluent.

In particular, the invention concerns the treatment of radioactive materials arising from the reprocessing of irradiated nuclear fuel in order to isolate that which is radioactive and confine it in a form which is capable of storage in a safe environment.

It is generally accepted that there are three levels of radioactive arisings from nuclear fuel reprocessing operations: low level, which is capable of being discharged to sea under carefully controlled conditions; and intermediate level and high level, both of which need treatment to concentrate the radioactive material and to confine it in a form capable of being stored in a safe environment for the periods necessary to ensure that its activity does not present a health hazard.

In particular, in the intermediate level arisings, treatment may be give which produces a floc which retains the radioactivity. This treatment includes the consecutive formation of precipitates of a ferrocyanide, hydroxides, barium sulphate, and a sulphide. Such intermediate level arisings are, for example, as a result of the reprocessing of irradiated Magnox fuel from the first generation of British nuclear power stations-uranium metal fuel encapsulated in magnesium alloy (Magnox) cans. Such arisings further include sludges and ion-exchange resins which result from storage and in-pond corrosion of the irradiated fuel in the storage ponds at reactor sites and at the reprocessing site, and also include pieces of the magnesium alloy cans which have been stripped from the irradiated uranium metal fuel. Furthermore, they can include various ferric/aluminium flocs resulting from the treatment of reprocessing liquid streams to remove therefrom, or reduce to acceptably low level, radioactivity prior to discharge to sea. The arisings are generally given a conditioning treatment to ensure that materials which could adversely affect subsequent encapsulation or storage are removed. Such materials may include salts, such as sodium sulphate and ammonium nitrate. The flocs, conditioned where necessary, include insoluble precipitates to which are tightly attached radioactive species, and considerable quantities of free water containing dissolved salts, which are non-radioactive. However, the amount of floc which can be incorporated into a solid fixation material matrix (by subsequent treatment with bitumen, cement matrices or the like) is limited by the weight of said non-active salts, as well as by the radioactive precipitates content, therefore requiring a greater quantity of fixation material than would be justified by the weight of radioactive precipitates alone. This leads to greater quantities of fixation material being used than is strictly necessary.

SUMMARY OF THE INVENTION

It has been found, and is the basis of the present invention, that by removing the mother liquor containing said soluble (inactive) salts from the active precipitates, by washing with water at least once, the amount of material required for fixation of the floc is reduced Thus, according to the present invention there is provided a method of treating radioactive floc, the floc being a suspension of precipitates carrying radioactive species in a mother liquor containing dissolved non-radioactive salts, the method comprising washing the floc with water to displace the mother liquor with clean water and thereafter encapsulating the washed floc in a solid matrix.

It is considered that any loss of active species from the floc by the said washing will be minimal and will only produce a low level of activity in the washing water well within the limits for discharge to the environment or passing to a further process. Furthermore, it is also considered that any changes for the worse which the washing might introduce in the settling characteristics of the floc will be within acceptable limits.

It has been found in some cases that it is preferable to postpone washing after floc production. This delay has the effect of maximising the decontamination factor brought about by the floc production. In some specific cases a few days may be beneficial but in other cases much longer periods would not seriously affect the efficiency of the invented process.

The production of flocs and their incorporation in a solid fixation material matrix, such as bitumen or cement, is well known and standard practice and as such does not require detailed description. Thus it is known to introduce floc into hot bitumen at a temperature in excess of 140° such that the liquid content of the floc is boiled off and the remaining solid content carrying the radioactivity is mixed with the bitumen. The resulting composition is allowed to set to form solid bodies in which the radioactivity is encapsulated by the bitumen.

In the present invention the floc is washed with water prior to the bitumenisation. The washing can be performed on a batch or a continuous basis and results in the displacement of the original liquid content of the floc, which contains dissolved salts, by clean water. The washed floc is then introduced into hot bitumen and encapsulated as in known and accepted manner. The amount of material to be encapsulated is reduced by the removal of the dissolved non-radioactive salts during the washing step. The amount of solidified radioactive waste obtained by bitumenisation is thus reduced resulting in advantages for the storage and disposal thereof.

Alternatively, the washed floc can be incorporated in other solid fixation materials such as cement.

By way of example a typical floc was contacted with an equal volume of water, was mixed, allowed to settle and the supernate withdrawn. This procedure was repeated four times. The total salts plus solids content of the floc was reduced from 29.4 w/o to 7.5 w/o and the loss of activity to the wash liquor was:

Total $\alpha$: 1%
Cs137: 0.01%
Sr90: 0.1%
Total $\beta$: 0.2%

I claim:

1. A method of treating radioactive effluent floc, the floc being a suspension of precipitates carrying radioactive species in a mother liquor containing dissolved non-radioactive salts, the method comprising adding water to the floc, mixing the floc and water to dilute the mother liquor content of the floc, allowing the floc to settle, withdrawing supernatant liquid from the water-treated floc, optionally repeating the previous steps, to isolate said radioactive floc and confine it in a form which is capable of storage and disposal, and finally encapsulating the residual water-treated floc in a solid matrix.

2. A method according to claim 1 including encapsulating the washed floc in bitumen.

* * * * *